US007355928B2

(12) United States Patent
Nanda

(10) Patent No.: US 7,355,928 B2
(45) Date of Patent: Apr. 8, 2008

(54) MOBILE WAKEUP DEVICE

(75) Inventor: Gauri Nanda, Rochester Hills, MI (US)

(73) Assignee: Massachusetts Institute of Technology, Cambridge, MA (US)

( * ) Notice: Subject to any disclaimer, the term of this patent is extended or adjusted under 35 U.S.C. 154(b) by 265 days.

(21) Appl. No.: 11/201,839

(22) Filed: Aug. 11, 2005

(65) Prior Publication Data

US 2007/0036034 A1 Feb. 15, 2007

(51) Int. Cl.
*G04C 23/02* (2006.01)

(52) U.S. Cl. ..... 368/72; 368/223; 368/262

(58) Field of Classification Search ..... None
See application file for complete search history.

(56) References Cited

U.S. PATENT DOCUMENTS 5,757,732 A * 5/1998 Kuo ..... 368/262
RE38,528 E * 6/2004 Glynn et al. ..... 368/72
2007/0008825 A1* 1/2007 Tang ..... 368/73

OTHER PUBLICATIONS

Flying Alarm Clock, Blowfly, http://www.gadget review.com/2005/12/flying-alarm-clock.html and supporting pages (total 5 pages).*

* cited by examiner

*Primary Examiner*—Renee Luebke
(74) *Attorney, Agent, or Firm*—Gordon E. Nelson

(57) ABSTRACT

A mobile wake-up device responds to a snooze-button in an alarm clock. The mobile wakeup device includes a mechanism for making the device mobile, a controller for directing the movement of the device and responding to input, and an alarm off input. When the alarm clock's alarm goes off and an individual activates the snooze button, the mobile wake-up device moves forward, drops from a table to the floor, and moves to a remote location. While moving, the device may use sensors to avoid objects in its path. After the mobile wake-up device has reached the remote location, the alarm signals again. To turn off the alarm, the individual must get out of bed and locate the mobile wake-up device.

32 Claims, 6 Drawing Sheets

MOBILE WAKEUP DEVICE

CROSS-REFERENCE TO RELATED APPLICATION

Not applicable.

STATEMENT REGARDING FEDERALLY SPONSORED RESEARCH OR DEVELOPMENT

Not applicabale.

REFERENCE TO A SEQUENCE LISTING

Not applicable.

BACKGROUND OF THE INVENTION

1. Field of the Invention

The invention relates to alarm clocks and more particularly to techniques used in alarm clocks to ensure that the user of the alarm clock is really awake when the user shuts off the alarm.

2. Description of Related Art

Most everyone has experienced problems waking up in the morning. In response to this need the alarm clock was developed to produce an audible signal to rouse an individual from their slumber. The original alarm clocks were mechanical in nature and caused a bell in the alarm clock to ring when a specified time was reached. Improvements in clock technology over time resulted in digital alarm clocks in which time was determined by electronic circuitry and displayed by a Light-Emitting Diode (LED) or other electronic display. The use of such electronic circuitry permitted further developments, among them the "snooze alarm". The object of the snooze alarm is to allow the alarm to be temporarily suspended while the individual catches a last few minutes of sleep.

The drawback to the snooze alarm is its abuse by its user. An individual who has been waked up by an initial alarm activates the snooze alarm and falls back to sleep. When the alarm is triggered a second time, the individual repeats the process by activating the snooze button again. This process can continue to repeat itself until the individual has slept past the time needed to get up to attend some important event. In attempting to prevent this, the individual can move the alarm clock to a new position across the room. The drawbacks in so doing are that the snooze button becomes useless, the alarm clock may be too far away to be readable, and the individual has to go to the clock to reset the time or the alarm.

It is an object of the invention to provide a wakeup device which may be located near the sleeper but requires the sleeper to get out of bed to turn the wakeup device off.

BRIEF SUMMARY OF THE INVENTION

The object of the invention is achieved by means of a mobile wake-up device. The mobile wake-up device responds to an alarm event in a clock having an alarm. The mobile wake-up device includes an input device that receives input that causes an alarm off event, a controller, and a mobility device. The mobility device operates under control of the controller. The controller responds to the alarm event by causing the mobility device to move the mobile wake-up device to a location that is remote from the mobile wake-up device's location upon occurrence of the alarm event. At the remote location, the controller causes the alarm to go off and responds to the alarm off event by causing the alarm to cease going off. The alarm event may include the alarm itself going off or the user activating a snooze button. The remote location reached can be based on a pattern or chosen randomly.

In another aspect of the invention, sensors can be used to make the mobile wake-up device aware of its internal condition or conditions external to the mobile wake-up device. Information from such sensors can be used to determine the presence of an object in the mobile wake-up device's path and to further avoid the object by changing direction or upon colliding with the object, cause the device to backup and change direction.

In another aspect of the invention, the mobile wake-up device has a docking station. The docking station providing a means for charging the battery internal to the mobile-wake up device. It is a further aspect of this invention, that the docking station portion of a mobile wake-up device contain the time display of the alarm clock, allowing the time to be viewed easily by the individual.

Other objects and advantages will be apparent to those skilled in the arts to which the invention pertains upon perusal of the following Detailed Description and drawing, wherein:

DETAILED DESCRIPTION OF THE INVENTION

Figure 1:
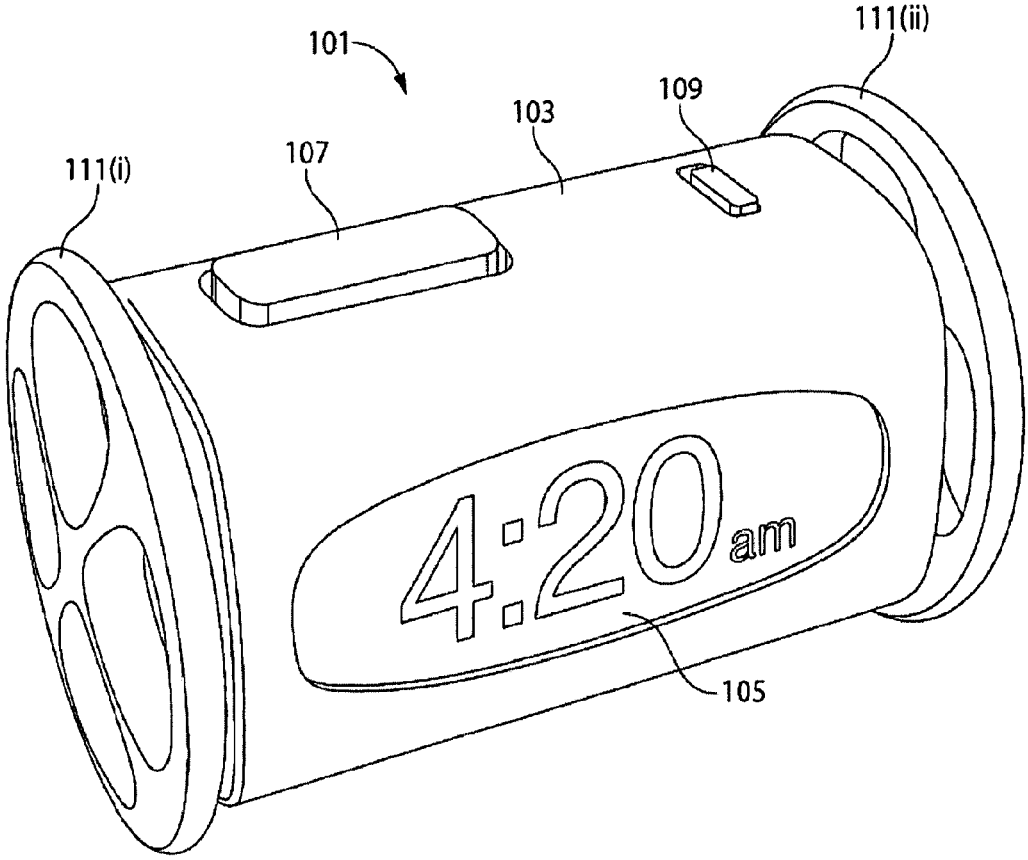
FIG. 1 shows a mobile alarm with clock apparatus.

FIG. 1 shows a presently-preferred embodiment 101 of a mobile alarm device. Mobile alarm device 101 is a mobile alarm clock. Like most alarm clocks, device 101 is placed on a nightstand next to the user's bed. Mobile alarm device 101 has an exterior body 103 that contains and protects the internal workings of the clock. On the front of the clock is a Liquid Crystal Diode or Light-Emitting Diode (LCD/LED) 105 for displaying the time. An on/off switch 109 activates or de-activates the alarm clock's alarm. A snooze button 107 turns off the alarm for a predetermined period of time. Not shown, but included in most alarm clocks are buttons for choosing whether a time value or and alarm lime value is to be set and buttons for advancing the values of the alarm time value or time value. Mobile alarm device 101 further contains a pair of wheels 111(*i* and *ii*). These wheels allow mobile alarm device 101 to be propelled forward in response to an alarm event such as the snooze button being activated. Wheels 111(*i* and II) are slightly larger than the body of the alarm clock 103 to allow mobile alarm device 101 to move. Wheels 111 (*i* and *ii*) are also larger to allow for the absorption of shock when mobile alarm device 101 rolls off the nightstand onto the floor. Springs may be added to the axle holding wheels 111(*i* and *ii*) to further absorb shock from the fall. The case 103 has the parts of the clock within situated as to create a low center of gravity. This arrangement keeps the orientation of the mobile alarm device such that the LCD/LED 105 remains visible. After moving forward and dropping off the nightstand onto the floor, mobile alarm device 101 moves to another point in the room. When mobile alarm device 101's alarm goes off again, the user can only turn off the alarm by getting out of bed and finding mobile alarm device 101.

Figure 2:
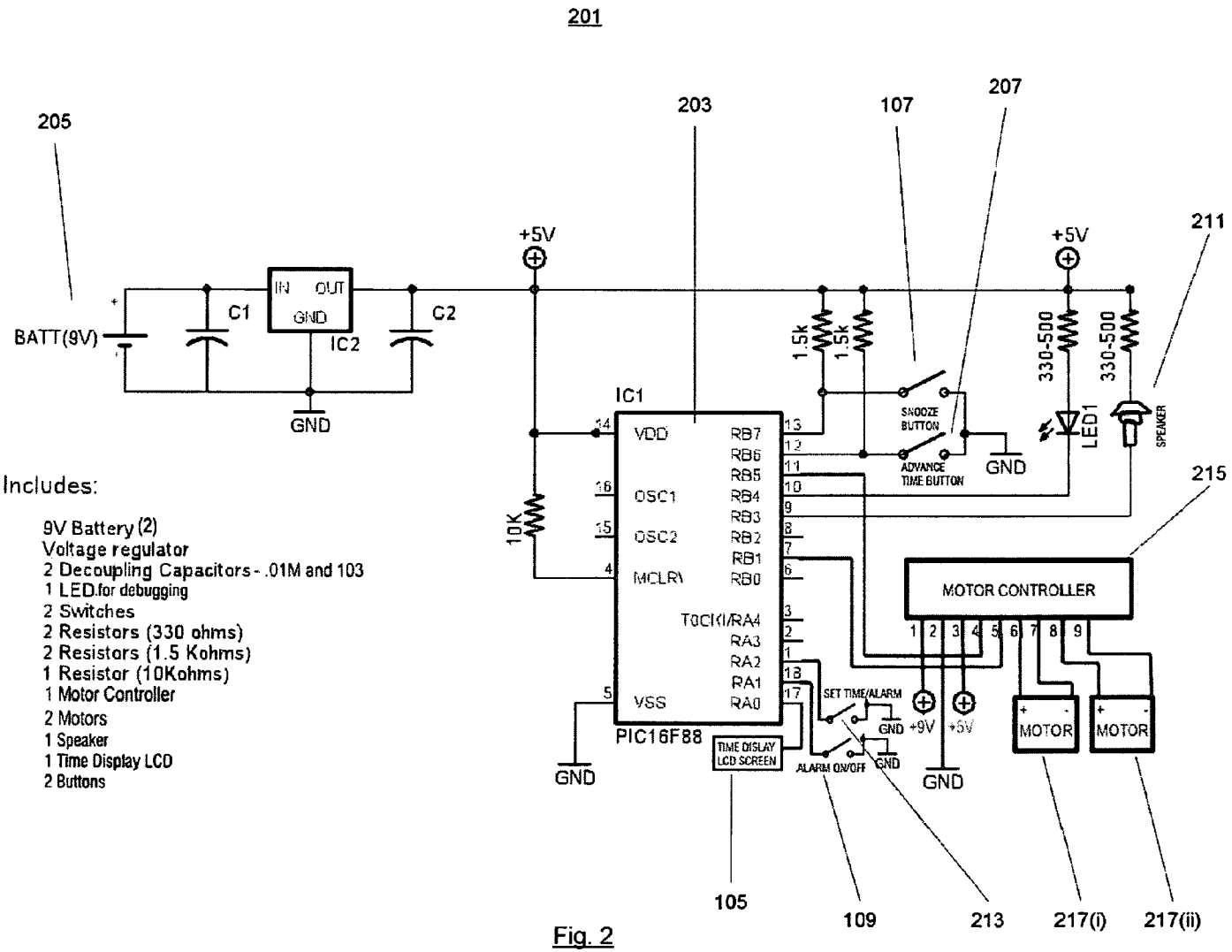
FIG. 2 shows a schematic for one embodiment of the invention.

FIG. 2 shows a schematic of the internals of a presently-preferred embodiment of mobile alarm device 101. Schematic 201 contains a controller 203 that controls the logic of mobile alarm device 101, including the time, alarm, and propulsion functions. Power to mobile alarm device 101 is supplied by battery 205. Time is displayed on LCD/LED 105. LCD/LED 105 can also display the time at which the alarm should go off. The alarm can be set using switch 213 to have LCD/LED 105 display the alarm time. The time displayed on LCD/LED 105 can be set using advance button 207. Advance button 207 can also be used to advance the time of the alarm clock when switch 213 is not set. In a preferred embodiment, the alarm is audible and is provided via speaker 211; in other embodiments, the alarm may be any physical manifestation that is capable of awaking the user.

When the alarm sounds, the user may either turn the alarm off or activate snooze button 107. In the latter case, controller 203 responds by turning off the alarm and setting the alarm so that it will go off again after a snooze period has elapsed. Additionally, controller 203 activates motor controller 215 that directs motors 217 connected to wheels 111(*i* and *ii*) to propel mobile alarm device 101 forward, so that it falls from the nightstand where it has been placed. Internal circuit board 201 is designed to help absorb the shock of falling from the nightstand. After landing on the floor, mobile alarm device 101 continues to move. Controller 203 may vary the times and directions of motion such that each time the user activates the snooze button, the mobile alarm device stops at a different location. Controller 203 may change the direction of mobile alarm device 101 by independently varying the speed of each of the motors 217 that drive wheels 111(*i* and *ii*). If one wheel 111(*i*) is turning faster than another wheel 111(*i*), mobile alarm device 101 will turn around the slower wheel. Wheels 111(*i* and *ii*) can also be moved in opposite directions to make mobile alarm device 101 pivot.

After a predetermined time has elapsed, mobile alarm device 101 comes to rest. When the snooze period expires, the alarm goes off again. The individual who activated the snooze button must now get up and locate mobile alarm device 101 in order to deactivate the alarm by activating switch 109. Now that the individual is out of bed, the alarm clock has completed its function.

Logic in controller 203 can cause mobile alarm device to become mobile in response to any kind of alarm event for which becoming mobile is desirable. In addition to the pressing of the snooze button, the alarm event could be the first instance of an alarm being signaled, a second instance of the snooze button being pressed, or a pre-programmed time, to name a few examples. In an alternate embodiment, controller 203 can include a microprocessor. The microprocessor may be capable of downloading new programs, and if it is, the user can change the kind of alarm event mobile alarm device 101 responds to and the way the device responds to the alarm event by downloading a new program for the device.

Figure 3:
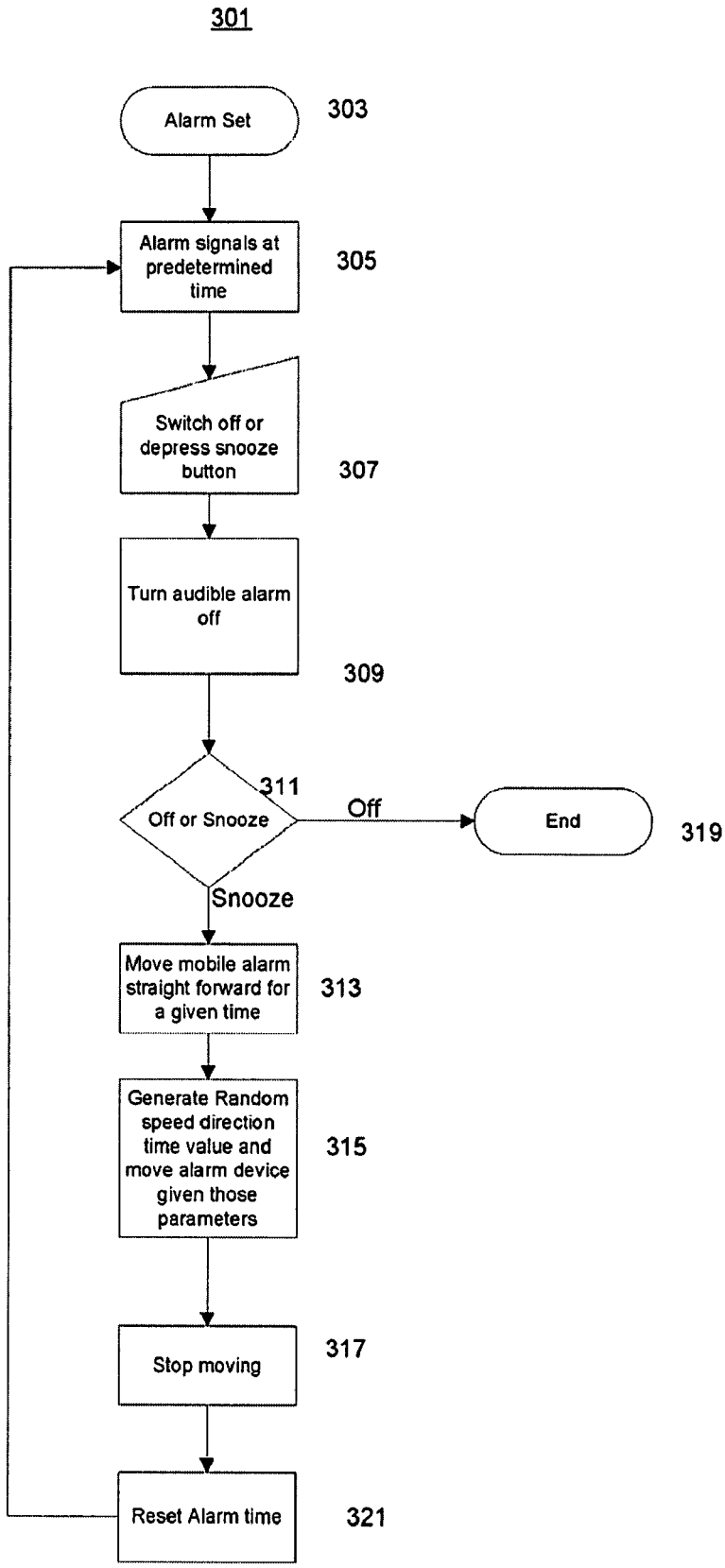
FIG. 3 shows a flowchart of the operation of a mobile alarm device.

FIG. 3 shows a flowchart 301 of how controller 203 responds to an alarm event. Flowchart 301 starts when the clock's alarm has been set (303). Audible alarm 211 is signaled (305) when a the time to which the alarm was set is reached (305). The user either switches the alarm off using switch 109 or depresses snooze button 107 (307). Either action turns off audible alarm 211 (309). If the alarm has been switched off, then proceed to end (319). If snooze button 107 has been depressed, move mobile alarm device 101 forward for a first predetermined period of time (313). The period of time chosen is long enough for mobile alarm device 101 to reach the edge of a nightstand and fall to the floor. Continue to move after mobile alarm device 101 is on the floor. Controller 203 uses randomly-generated parameters which it provides to motor controller 215 to determine the direction of movement, its speed, and the length of time it continues in a given direction. The movement continues for a second predetermined period of time (315). Mobile alarm device 101 moves in the directions specified by the direction parameters until the second time period has elapsed; at that point, mobile alarm device 101 comes to rest (317). When the snooze period has elapsed, (321), the alarm is sounded (305).

The manner in which mobile alarm device 101 behaves may be improved by adding components that make mobile alarm device 101 aware of itself and its environment. Counters that record the rotation count of wheels 111(*i* and *ii*) can be used to determine whether mobile alarm device 101 has stopped moving forward. A slow change indicates that mobile alarm device 101 is making no forward movement. Counter rate increase to a steady state indicates forward movement. The counters could also be used to determine if mobile alarm device 101 is in mid-air as it would be when dropping off a nightstand. During the period of the fall, wheels 111(*i* and *ii*) would spin at a higher rate. Watching the higher counter rate could allow the controller 203 to determine when to start changing the direction of movement of mobile alarm device 101. When the manner in which wheels 111(*i* and *ii*) are rotating indicates that no forward movement is occurring, mobile alarm device 101 can evade the obstacle by reversing direction, turning, and moving on in the new direction. Sensors that make mobile alarm device 101 aware of its external environment can also be used. Proximity sensors could let the alarm device know how close it is to another object, allowing it to turn before hitting the object. There are many types of proximity sensors: sonic sensors, radio wave sensors, magnetic sensors, or photo-beam sensors, to name a few. The kind of sensor used will of course depend on factors like cost and the kind of environment mobile alarm device 101 is to be used in.

Figure 5:
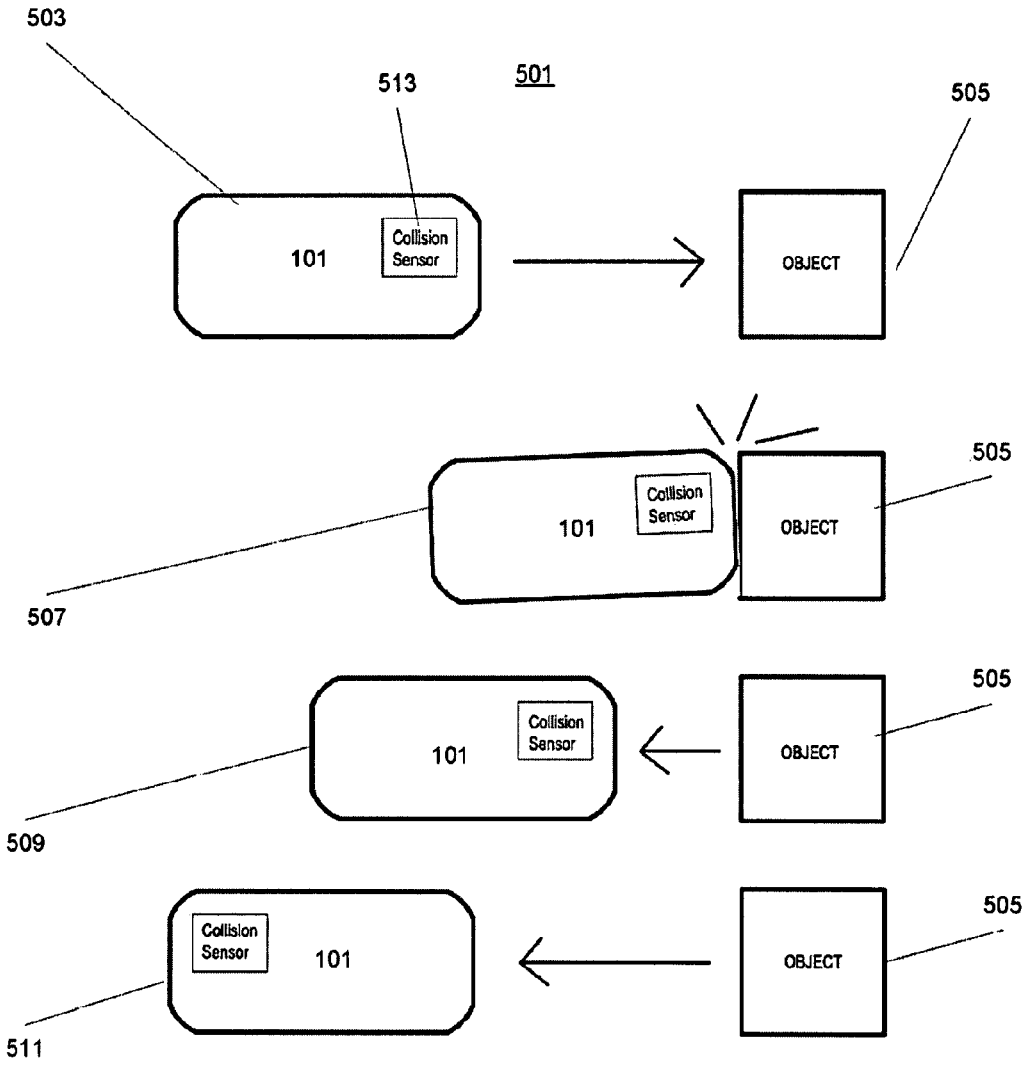
FIG. 5 shows a mobile alarm device changing direction in response to striking an object.

FIG. 5 shows a mobile alarm avoiding an object in its path in response to a sensor. In a first instance 503 the alarm device 101 is proceeding forward across the floor of a room towards an object 505. In instance 507 the alarm device 101 strikes the object 505. Collision sensor 513 detects a physical collision or a potential collision. That a collision or potential collision has been detected is relayed to controller 203. Controller 203 causes motor controller 215 to have motors 217 reverse direction. This in turn causes mobile alarm device 101 to reverses direction (509) and proceed away from the object (511). The sensitivity of mobile alarm device 101 to its environment will vary with the sophistication of its sensors and the amount of computing power and memory it has. To give an extreme example, if mobile alarm device 101 can detect the presence of objects either by running into them or by using photonic or sonic sensors, mobile alarm device 101 can be placed on the floor and be permitted to "explore" its surroundings. As it does so, it can make a map of the surroundings. It can then use the map to determine the route it will take when it is moving in response to an alarm event.

Figure 4:
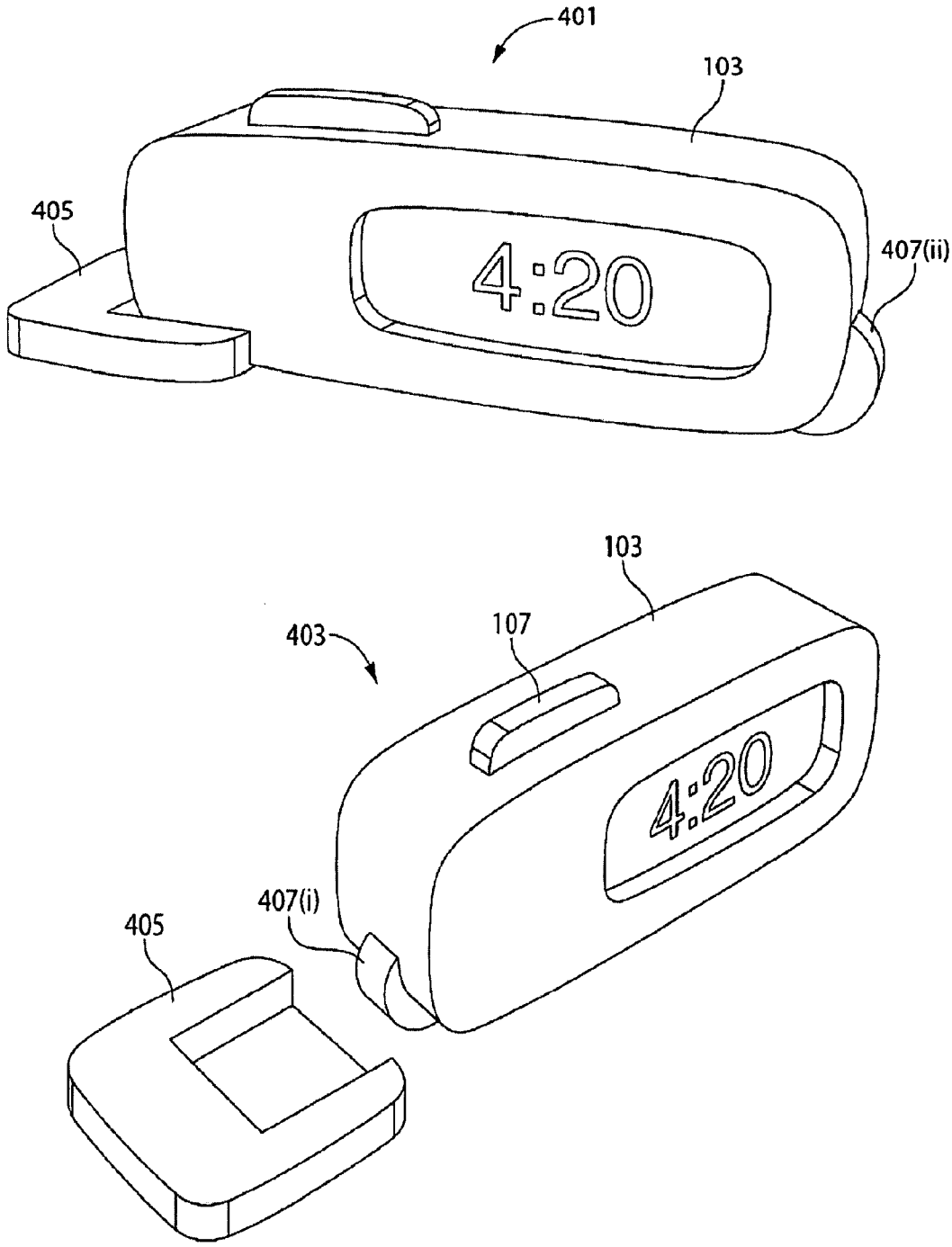
FIG. 4 shows a mobile alarm device that separates from a charging base.

FIG. 4 shows a several views of a mobile alarm device with docking station. Mobile alarm device 401 is in a docking station 405 that contains a mechanism for charging battery 205 held in the body of mobile alarm device 103. Mobile alarm device 401 contains a set of wheels 407 for propelling mobile alarm device 401 from its docking station 405. Mobile alarm device 403 separates itself from the docking station 405 after snooze button 107 has been depressed.

The time display need not be part of mobile alarm device 101, but can instead remain on the nightstand, where it can be easily viewed by the sleeper. The minimal requirements for mobile alarm device 101 are that it be mobile, start moving in response to an alarm event, and have a switch which turns off the alarm. If the alarm is in mobile alarm device 101, the switch can turn off the alarm directly; otherwise mobile alarm device 101 can generate a signal in response to the switch that in turn causes the time display on the night stand to turn off the alarm. The time display and the mobile alarm device 101 can contain communications equipment such that they can share information by radio or infrared. If there is a docking station, the time display can be part of the docking station.

Figure 6:
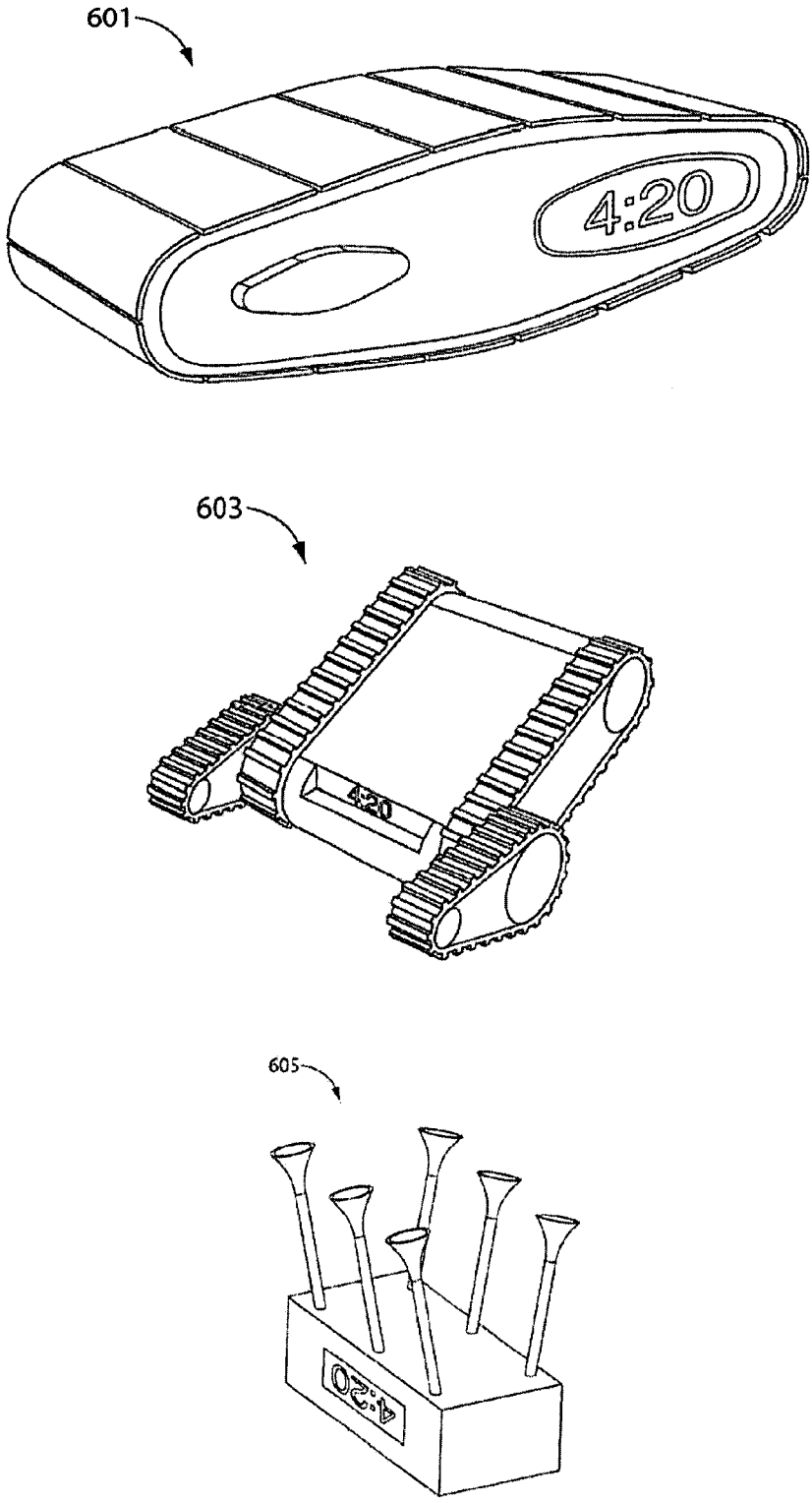
FIG. 6 shows several other ways of propelling a mobile alarm Reference numbers in the drawing have three or more digits: the two right-hand digits are reference numbers in the drawing indicated by the remaining digits. Thus, an item with the reference number 203 first appears as item 203 in FIG. 2.

FIG. 6 shows several different ways of making the mobile alarm mobile. Tracks instead of wheels allow mobile alarm device 601 to cross more varied terrain such as a deep shag carpet where a wheeled mobile alarm device 101 may become bogged down. A tracked mobility unit with arms allows alarm device 603 to climb over objects in its path or ascend or descend stairs. A mobility unit with legs like an insect allows alarm device 605 to walk across its terrain. Alarm device 605 is weighted so that it always falls on its back. Like an insect, it can right itself. The mobility units shown in FIG. 6 are illustrative and exemplary only; any device which makes it possible for mobile alarm device 101 to move out of reach of the sleeper may be employed in place of the wheels used in mobile alarm device 101 or of any of the mobility units shown in FIG. 6.

CONCLUSION

The foregoing Detailed Description has disclosed to those skilled in the relevant technologies how to make and use a mobile alarm device and has further disclosed the best mode presently known to the inventor for implementing the mobile alarm device. It will however be immediately apparent to those skilled in the relevant technologies that the mobile alarm device may be implemented in many other ways. For example, mobility units that pull, winch, or vibrate could be used; many different kinds of alarm events can cause the mobile alarm device to begin moving, and many techniques can be used to define how the mobile alarm device moves. These techniques may include varying the behavior of the mobile alarm device in response to sensors. Users may be able to vary the behavior of a mobile alarm device by programming it themselves or by downloading a preexisting program. At the other technological extreme, mobile alarm devices with simple behaviors can even be implemented in mechanical clockwork.

For all of the foregoing reasons, the Detailed Description is to be regarded as being in all respects exemplary and not restrictive, and the breadth of the invention disclosed herein is to be determined not from the Detailed Description, but rather from the claims as interpreted with the full breadth permitted by the patent laws.

The invention claimed is:

1. A mobile wake-up device that is responsive to an alarm event in a clock having an alarm, the mobile wake-up device comprising:

an input device that receives input that causes an alarm off event;

a controller that receives and responds to the alarm event and to the alarm off event; and a mobility device that includes the input device, the mobility device operating under control of the controller, the controller responding to the alarm event by causing the mobility device to move the mobile wake-up device to a location that is remote from the mobile wake-up device's location upon occurrence of the alarm event and thereafter causing the alarm to go off and responding to the alarm off event by causing the alarm to cease going off.

2. The mobile wake-up device of claim 1 wherein:

the controller causes the variations to vary according to a pattern.

3. The mobile wake-up device of claim 2, wherein:

the pattern is random.

4. The mobile wake-up device of claim 1, wherein:

the alarm event is a snooze button being set.

5. The mobile wake-up device of claim 1, wherein:

the alarm event is the alarm going off.

6. The mobile wake-up device of claim 1, wherein:

the alarm event is the alarm that is going off being turned off.

7. The mobile wake-up device of claim 1, wherein:

the alarm event is the alarm going off for a predetermined period of time.

8. The mobile wake-up device of claim 1, wherein:

the controller causes the mobility device to move with variations in speed, distance and/or direction.

9. The mobile wake-up device of claim 2, wherein:

in response to the alarm event, the controller causes the mobility device to move such that the mobile wake-up device falls from a nightstand.

10. The mobile wake-up device of claim 9, wherein:

the mobile wake-up device having fallen from the nightstand, the controller directs the mobility device to proceed in a random direction, for a random time, and/or at a random speed.

11. The mobile wake-up device of claim 2, further comprising:

a sensor; and the controller responds to the sensor by causing the device to move with the variations.

12. The mobile wake-up device of claim 11, wherein:

the sensor is aware of an internal condition of the mobile wake-up device.

13. The mobile wake-up device of claim 12, wherein:

the sensor is aware that mobile wake-up device has fallen from a nightstand to a floor and the controller responds to the sensor by causing the mobility device to proceed according to a pattern.

14. The mobile wake-up device of claim 11, wherein:

the sensor is aware that the mobile wake-up device is making no movement in a direction and the controller responds thereto by causing the mobile wake-up device to change direction.

15. The mobile wake-up device of claim 14, wherein:

the direction is changed by causing the mobility device to reverse direction, turn, and proceed in a new a direction.

16. The mobile wake-up device of claim 11, wherein:

the sensor is aware of a condition external to the mobile wake-up device.

17. The mobile wake-up device of claim 16 wherein:

the sensor detects an object in the mobile wake-up device's path and in response to the sensor, the controller causes the mobile wake-up device to avoid the object.

18. The mobile wake-up device of claim 17 wherein:

the controller causes the mobility device to avoid the object by reversing direction, turning, and proceeding in a new direction.

19. The mobile wake-up device of claim 1, wherein:

the mobile wake-up device includes the clock.

20. The mobile wake-up device of claim 1 wherein:

the mobile wake-up device is separate from the clock.

21. The mobile wake-up device of claim 20 wherein:

the mobile wake-up device separates itself from the clock when the controller causes the mobility device to move the mobile wake-up device.

22. The mobile wake-up device of claim 20, further comprising:

wireless communications devices in the clock and the mobile wake-up device, the wireless communication device in the clock communicating the occurrence of the alarm event to the mobile wake-up device.

23. The mobile wake-up device of claim 1 further comprising:

a battery, the battery providing power for the mobile wake-up device; and a docking station, the docking station providing a mechanism for charging the battery of the mobile wake-up device and the mobile wake-up device separating from the docking station upon an alarm event.

24. The docking station of claim 23 wherein:

the docking station includes the clock.

25. An alarm clock comprising:

a case containing a clock, an alarm that may be turned off, a snooze button that silences the alarm for a snooze period, a controller responsive to the snooze button, and a motor that is controlled by the controller, the case being carried on wheels that are coupled to the motor and the controller responding when the snooze button is pressed by causing the motor to turn the wheels such that the alarm clock moves to a location different from the alarm clock's location at the time the snooze button was pressed, whereby the alarm clock must be located at the end of the snooze period in order to turn off the alarm.

26. The alarm clock set forth in claim 25 wherein:

the wheels are external to the case.

27. The alarm clock set forth in claim 26 wherein:

the wheels are of a size such that no part of the case touches the ground.

28. The alarm clock set forth in claim 26 wherein:

the case has ends and the wheels are at the ends.

29. The alarm clock set forth in claim 25 wherein:

the controller varies at least the speed at which the motor runs.

30. The alarm clock set forth in claim 25 wherein:

the wheels are located relative to the case such that when the wheels turn at differential rates, the case turns around the slower wheel.

31. The alarm clock set forth in claim 30 wherein:

there is a further motor, the motor being coupled to one of the wheels and the further motor being coupled to an other wheel; and the controller varies the speed of the motor and the further motor independently.

32. The alarm clock set forth in claim 31 wherein:

the controller varies the speed of the motor and the further motor according to a randomly-determined parameter.

* * * * *